United States Patent [19]

Wright

[11] 4,190,032

[45] Feb. 26, 1980

[54] FLOW HOMOGENIZER

[76] Inventor: Albert T. Wright, 4 Palmer Ave., Corinth, N.Y. 12822

[21] Appl. No.: 964,471

[22] Filed: Nov. 29, 1978

[51] Int. Cl.[2] ..... F02M 7/22

[52] U.S. Cl. ..... 123/141; 261/44 A; 261/44 E; 261/DIG. 56

[58] Field of Search ..... 123/141; 261/44 A, 44 E, 261/44 G, 50 R, 41 B, DIG. 56

[56] References Cited

U.S. PATENT DOCUMENTS

| | | | |
|---|---|---|---|
| 1,430,001 | 9/1922 | Bennett | 261/44 A |
| 2,017,239 | 10/1935 | Fitzgerald | 261/44 E |
| 2,325,010 | 7/1943 | McCurdy | 261/41 B |
| 2,562,936 | 8/1951 | Moore et al. | 123/141 |
| 2,709,579 | 5/1955 | Sykes | 261/DIG. 56 |
| 2,995,349 | 8/1961 | Kennedy | 261/44 A |
| 3,086,758 | 4/1963 | Greene | 261/41 B |
| 3,659,572 | 5/1972 | Pelizzoni | 261/DIG. 56 |
| 3,965,221 | 6/1976 | Englert et al. | 261/DIG. 56 |
| 4,044,077 | 8/1977 | Gupta | 123/141 |

*Primary Examiner*—Ira S. Lazarus

*Attorney, Agent, or Firm*—Kane, Dalsimer, Kane, Sullivan & Kurucz

[57] ABSTRACT

A flow homogenizer for an internal combustion engine which can be used as a carburetor or as a booster for a carburetor. The homogenizing unit includes a hollow housing open at both sides. One tube extends through the wall of the housing and is adapted to be connected to a fuel source. A second tube is concentrically mounted on the first tube in tight fitting relationship while being able to rotate about the first tube. The first tube contains at least one slot and the second tube a plurality of holes in a predetermined arrangement and positioned so that as the second tube rotates relative to the first tube the number of holes exposed to each slot is changed thereby controlling the size of opening for fuel to flow through the holes into the housing. A damping member is mounted on the second tube in the housing to rotate therewith. The damping member has a recess in a surface portion thereof to expose the openings in the second tube and to open the passageway through the housing from end to end. The damping member is rotatable between a closed position blocking the opening between the ends of the housing and open positions exposing the recess of the damping member to both ends of the housing. The open positions are coordinated with the number of holes exposed to the slot as the damping member is rotated thereby facilitating close control of the fuel and air mixture passing through the housing. The homogenizer is adapted to be connected to a source of vacuum for drawing the fuel and air mixture therethrough. Controls can be connected to the homogenizer for rotating the second tube in a desired manner to control the fuel and air mixture parameters when the homogenizer unit is mounted on an internal combustion engine. A baffle is provided in position with respect to the recess to create turbulence and breakdown the particles of fuel and agitate the air to form a substantially complete homogenized air and fuel mixture of uniform size and even distribution for introduction to the manifold of an internal combustion engine.

12 Claims, 6 Drawing Figures

FIG. 1
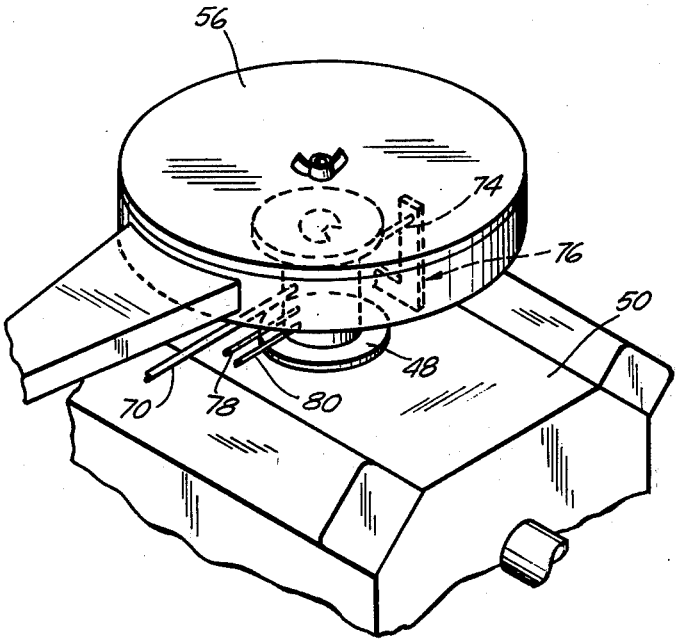
FIG. 5
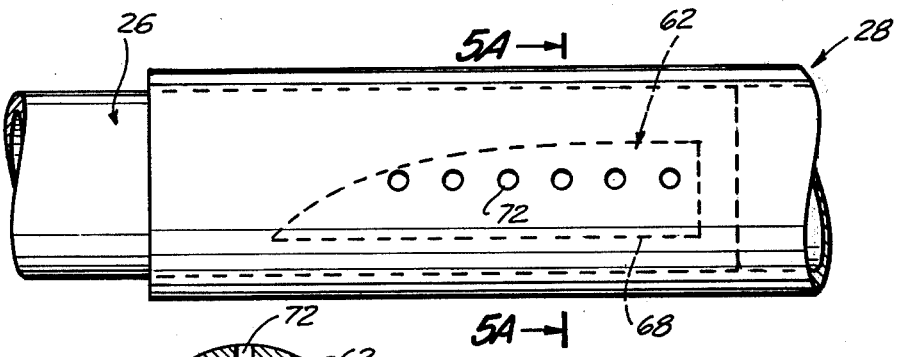
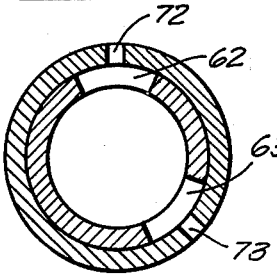
FIG. 5A

FLOW HOMOGENIZER

BACKGROUND OF THE INVENTION

In dealing with internal combustion engines, a primary concern in this day and age of energy conservation is fuel waste. More and more work is being done in connection with engine design for increasing gas mileage and accordingly reducing fuel consumption while providing better performance for the engine. This is particularly true with regard to passenger vehicles where gasoline consumption is a major concern.

In dealing with known types of carburetor structures for providing the desired gasoline and air mixture for use in an automobile engine many types of controls and complex structures are presently being employed. Certain designs require different fuel mixtures for different cylinders and devices commonly known as rich/lean cylinders are utilized.

Additionally, gasoline is often consumed unnecessarily during motor idling times. Many existing carburetors require a relatively high idling speed and excessive gasoline consumption is the result.

Furthermore, in conventional carburation systems, accelerator pumps and automatic chokes are used in the complex structures for enhancing the operation of the internal combustion engine. A system which would eliminate some of these more complex interconnected structural elements would be extremely advantageous in reducing the costs both in respect to engine construction and in respect to fuel consumption.

It should also be kept in mind that cost is of concern regard to the carburetor individually and in combination of the remainder of the engine.

SUMMARY OF THE INVENTION

With the above background in mind, it is among the primary objectives of the present invention to provide a flow homogenizer unit for an internal combustion engine which improves the fuel and air mixture characteristics of the carburetor portion of the engine in a manner which reduces fuel costs. The unit also reduces manufacturing costs by eliminating engine structural elements along other features.

The present invention provides a flow homogenizer which is usable as an engine carburetor or a booster for a carburetor, is of low cost and simple construction, and can be quickly and efficiently installed at low cost. The homogenizer is designed so that gas consumption is reduced to the point where more than a 50% increase in miles per gallon can be obtained without loss of performance or top speed. The unit is designed so that a smooth running, high performance engine is produced with an efficient carburetor.

It is designed for use in automobiles and can easily be adapted for use in other engine designs used in aircraft, boat and lawn mower environments. Naturally many types of engines are contemplated within the present invention including those employed in vehicles as large as trucks and as small as subcompact automobiles.

The simplicity of the homogenizer unit design in use as a carburetor eliminates the necessity of common types of engine components such as accelerator pumps and automatic chokes. This also includes related components associated with these parts which add to the complexity and cost of the carburetor and the engine.

The resultant of fuel and air mixture produced by the simple structure of the present device is a cleaner product for introduction to the manifold and provides reduced wear for tuneup purposes. Smoother engine operation is produced along with a reduction in wear and tear on the power train, differential, transmission and other engine structural elements. It is a further objective to provide a unit which eliminates the necessity for gas storage on top of the engine. This is a safety feature that presently does not exist with many known engine designs.

There is also less wear and tear on the starter, the battery and where applicable, cranking is eliminated. Immediate firing is achieved as an objective of the present structure in use in carburetor design. Naturally the simplicity of this design eliminate or alleviates carburetor repair problems.

It is contemplated that the present flow homogenizer can be used as an auxiliary to an existing carburetor system such as a booster or overdrive. Also, it can be used in tandum with other carburetor type units for improved engine performance.

In summary, a flow homogenizer for an internal combustion engine is provided which is adapted for use as part of or in place of common types of internal combustion engine carburetors. The homogenizer unit includes a hollow housing open at both ends. A first tube extends through the wall of the housing and is adapted to be connected to a fuel source. A second tube is concentrically mounted on the first tube in tight fitting relationship but is able to rotate about the first tube. The first tube has at least one slot therein in a portion thereof in the housing and the second tube has a plurality of holes therein in a predetermined arrangement and positioned so that as the second tube rotates relative to the first tube the number of holes exposed to each slot can be changed thereby controlling the size of opening for fuel to flow through the holes into the housing. A damping member is mounted on the second tube in the housing to rotate therewith and the damping member has a recess in a surface portion thereof to expose the openings in the second tube and to open the passageway through the housing from end to end. The damping member is rotatable between a closed position locking the opening between the ends of the housing and open positions exposing the recess in the damping member to both ends of the housing. The open positions are coordinated with the number of holes exposed to the slot as the damping member is rotated thereby facilitating close control of the fuel and air mixture passing through the housing. The homogenizer is adapted to be connected to a source of vacuum for drawing the fuel and air mixture therethrough. Finally, means is on the homogenizer for attachment to control means for rotating the second tube and damping member in a desired manner to control fuel and air mixture parameters.

A baffle is provided to create turbulence in the air as it is introduced to the homogenizer and to reduce the minute particles of fuel introduced to the homogenizer to provide uniform size and distribution of the fuel evenly in the flow of air. The result is an improved air and fuel mixture for introduction to the manifold of the engine.

With the above objectives among others in mind, reference is made to the attached drawings.

BRIEF DESCRIPTION OF THE DRAWINGS

In the Drawings:

FIG. 1 is a fragmentary perspective view of an internal combustion engine with the flow homogenizer of the present invention mounted thereon;

FIG. 5 is an enlarged fragmentary plan view of the two concentric tubes of the homogenizer of the invention showing the relationship between the holes in one tube and the slot in the other tube; and FIG. 5A is a sectional end view thereof taken along the plane of line 5A—5A of FIG. 5.

DETAILED DESCRIPTION

Figure 2:
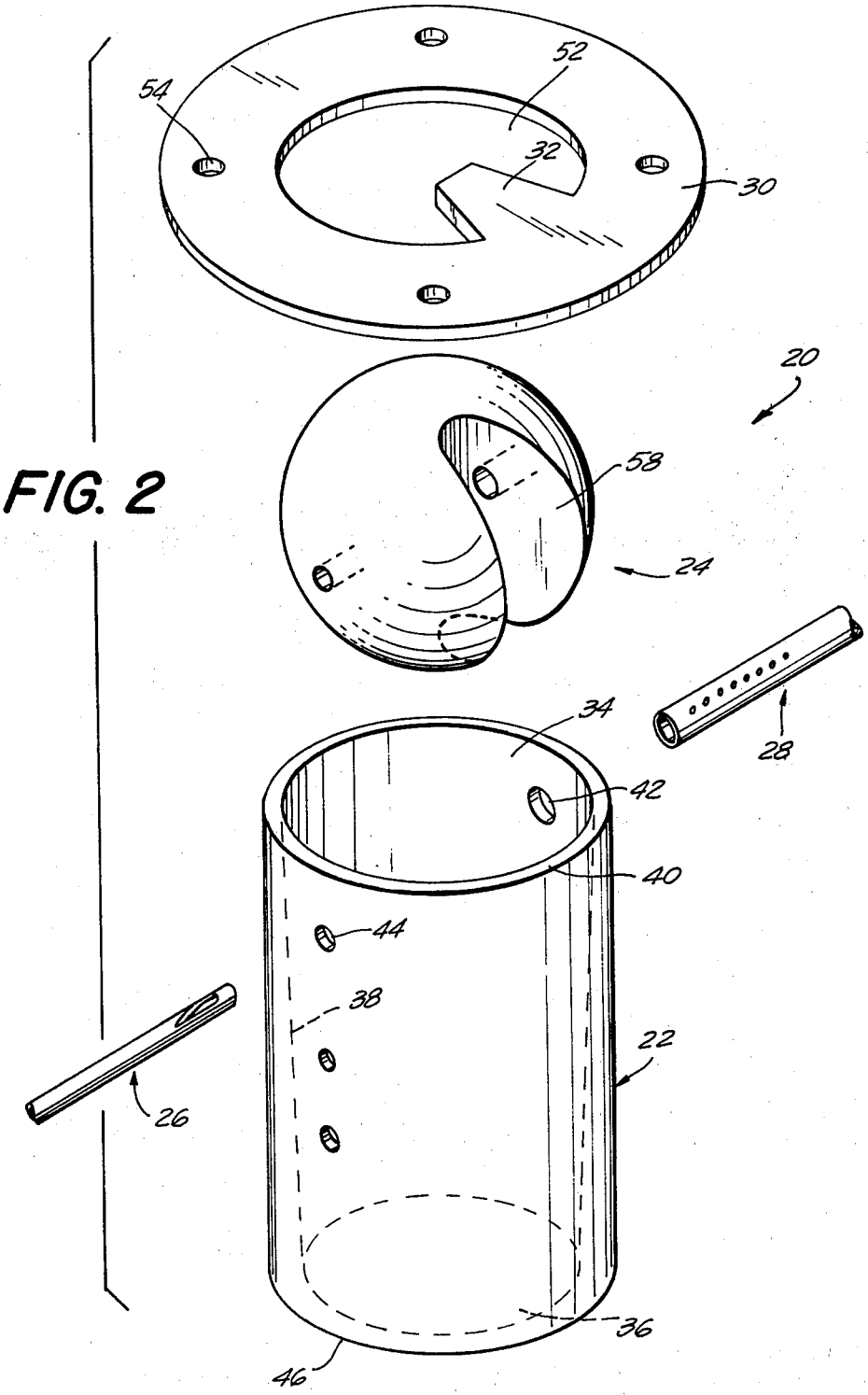
FIG. 2 is an exploded perspective view of the flow homogenizer of the invention.

Flow homogenizer 20 of the invention is shown in exploded form in FIG. 2 and includes a hollow tubular housing 22, a damping member in the form of a ball 24, a pair of concentrically assembled tubes 26 and 28, and a top plate 30 which includes a baffle 32.

The housing 22 is in the form of a hollow substantially cylindrical tube with an open upper end 34 and an open lower end 36. The wall 38 of housing 22 is tapered inwardly from top to bottom on its under surface so that it has a frustoconical configuration. It has been found effective, for example, to form the tapered surface of wall 38 so that it is shaped from 2⅜th inches at the wider diameter top end down to 2 inches at the narrow diameter bottom end. Adjacent to the upper edge 40 of housing 22 are a pair of diametrically opposed holes 42 and 44.

Figure 4:
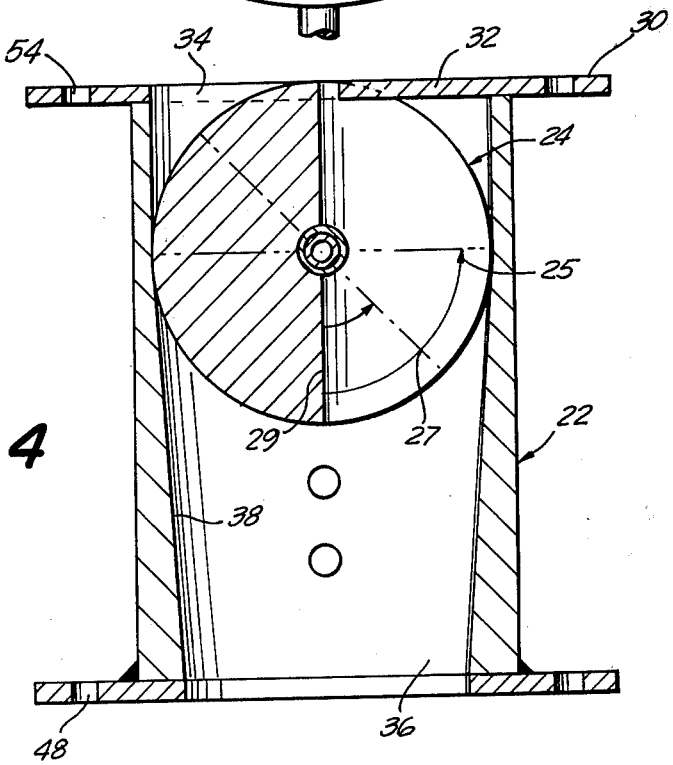
FIG. 4 is a sectional side elevation view thereof taken along the plane of line 4—4 of FIG. 3 showing the unit in the fully open position and in phantom showing the unit in a lesser opened position and a closed position.

Bottom edge 46 is designed to be welded or otherwise conventionally fastened to a base plate 48 as shown in FIG. 4. A base plate 48 is mounted in a conventional manner to the manifold of an internal combustion engine 50 as shown in FIG. 1. The mounting is accomplished in conventional fashion so that opening 36 in the bottom end of housing is in fluid communication with entrance to the manifold of engine 50.

Top plate 30 is welded or otherwise conventionally fastened to top edge 40 of the housing. The top plate 30 has a central opening 52 in position for alignment with the open upper end 34 of housing 22. Baffle 32 extends inwardly from the peripheral edge of opening 52 and overlies a portion of opening 34 when the top plate is mounted to the house. The top plate 30 has a plurality of spaced apertures 54 which facilitate mounting of a conventional air filter assembly 56 to the top plate.

Damping member 24 is in the form of a ball or sphere with an arcuate recess 58 in a portion of its surface. A hole 60 extends diametrically through the approximate center of the ball 24 and communicates with the recess on opposing sides thereof.

Tube 26 can be considered as a first concentric tube and at a preselected portion along its length includes a pair of spaced slots 62 and 63 cut in the side wall. The slots, as shown in FIG. 5A, are spaced apart about one third of the circumference of the tube 26. While two slots are shown as the preferred form, other slotted arrangements such as a single slot has also been found to work effectively. Each slot includes an axially extending edge 64 connected at right angles with a shorter peripherally extending edge 66. The free ends of edge 64 and 66 are interconnected by an arcuate cut resulting in edge 68. Tube 26 is hollow and is adapted to be connected at one free end 70 to a source of fuel such as gasoline in a conventional fashion.

The second tube 28 has a slightly larger inner diameter than the outer diameter of tube 26 so that it can be mounted on tube 26 in relatively tight interengaging relationship. However, while fitted snug, rotation of the second tube about the first tube is permitted. Passing through the wall of larger diameter tube 28 is a series of holes 72 formed in an aligned row in an axial direction. A second series of holes 73 is formed in an aligned axial row and is spaced from the row of holes 72 about one third of the distance around the circumference of tube 28. Thus there is a row of holes for each slot and, once again, the number of rows of holes is a matter of choice depending on a corresponding number of slots. When tubes 26 and 28 are assembled in concentric form as shown in detail in FIG. 5, the row of holes 72 is positioned proximate to the slot 62 and the row of holes 73 is positioned proximate to the slot 63. Thus, relative rotation between the tubes causes a different number of holes to be exposed as the relative rotation is accomplished in either direction. As shown in FIGS. 5 and 5A, rotation of outer tube 28 counterclockwise with respect to inner tube 26 will expose a larger number of holes 72 and 73 to the slots 62 and 63 respectively. Conversely, when the outer tube 28 is rotated clockwise with respect to inner tube 26 a lesser number of holes 72 and 73 will be exposed to slots 62 and 63 respectively. Thus, the aperture size through the side walls of the concentric tubes for the passage of gasoline entering through open end 70 of the inner tube is controlled.

Figure 3:
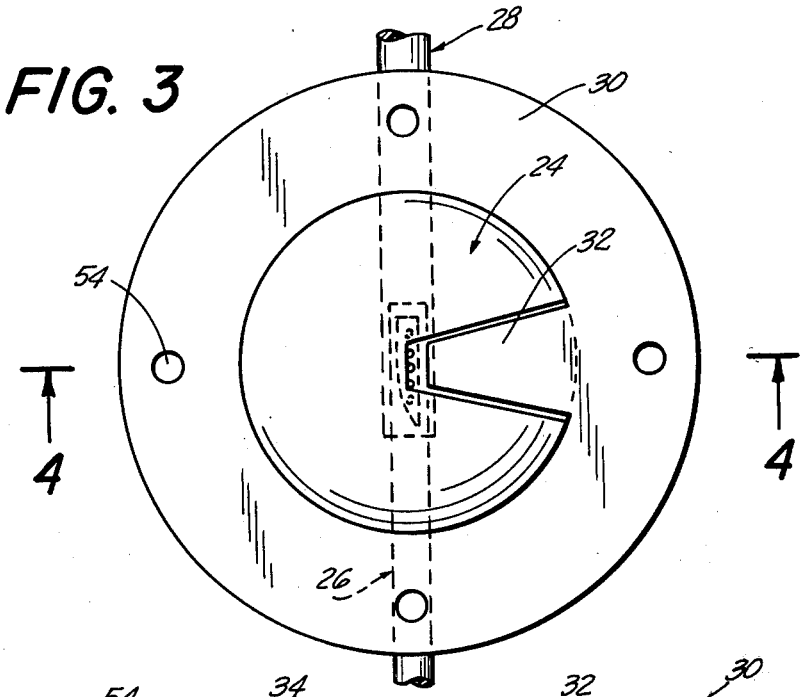
FIG. 3 is a top plan view of the flow homogenizer of the invention.

The concentric tubes 26 and 28 are passed through opposing apertures 42 and 44 in the housing and through opening 60 in ball 24 in assembling homogenizer 20. As shown in FIG. 3, tube 26 passes partially through opening 44 and has its end positioned in the adjacent end of tube 28 which has passed through opening 42 in the housing. End 70 extends from one side of housing 22 and a free open end 74 extends from the other side of housing 22. The concentric portions are aligned so that the openings 72 and 73 and slots 62 and 63 are in respective alignment with each other and are also exposed in recess 58 in ball 24. Thus, fuel entering through aperture 70 will pass through slots 62 and 63 and whatever openings 72 and 73 are exposed, into the recess 58 of ball 24 from where it can pass downward through bottom opening 36 into the manifold of the engine.

The free end 74 of outer tube 28 which extends from housing 22 is closed by a foot peddle linkage arrangement 76. This assembly 76 is adapted to be interconnected in conventional fashion to the foot peddle of a motor vehicle containing engine 50 such as an automobile. Operation of the foot peddle will cause rotation of the concentric tube 28 and also the ball 24 which is mounted rigidly in tight frictional engagement on the concentric tubes. This mounting of the ball on the tubes can be accomplished by friction or by other conventional fastening means. The interconnection between the ball 24 and the outer tube 28 is tight enough so that the ball turns as the tube turns, thus correspondingly developing a relationship between the number of openings 72 and 73 exposed to slots 62 and 63 respectively and the size of the portion of the recess 58 exposed to the lower end of the housing 22. Air enters through opening 52 of the top plate 30 contacting baffle 32 which causes turbulence in the air as it thereafter passes into recess 58 where it turbulently mixes with gasoline entering recess 58 through holes 72 and 73. The resultant mixture then passes through the bottom end of recess 58 and out though open end 36 of the housing 22 into the manifold of engine 50 for use.

Movement of the gas through top opening 34 and the fuel through open end 70 of tube 26 into housing 22 is facilitated by vacuum created by the engine in a conventional manner. The connection to a source of vacuum can be made in a conventional manner to the standard existing vacuum system in the internal combustion engine on which the homogenizer is mounted.

Conventional vacuum lines 78 and 80 passing through the wall 38 of housing 22 adjacent to lower edge 46 are used for drawing vacuum for accessories on the car including timing in a conventional manner. As shown, there are two vacuum lines. However, three or four or more can be employed for vacuum pull.

Linkage 76 can be attached to the conventional foot peddle of the vehicle such as an automobile foot peddle so that depression of the accelerator will cause rotation of ball 24 and outer tube 28 to expose additional holes 72 and 73 to slots 62 and 63 respectively for an increased gas input to mix with an increased air input achieved as the recess 58 is opened further. In the idling position with no pressure on the foot peddle of the vehicle, linkage 76 will be rotated to a position 25, shown in phantom in FIG. 4, where ball 24 virtually closes upper open end 34 so that a minimum amount of air is drawn into housing 22 and also minimum gas flow occurs through the tubes, for example, with only a single hole 72 and 73 exposed to the slots 62 and 63 respectively. Thus a small amount of gas and air in the idling condition are drawn into housing 22 to be introduced to the manifold of engine 50 through bottom opening 36. Naturally, as the accelerator is depressed greater air opening and fuel openings are provided proportionately so that the engine will run smoothly while still maintaining the fuel usage under close control. An intermediate position 27 is shown in FIG. 4 in phantom. The fully opened position 29 is the depicted condition in FIG. 4 with maximum exposure for air to traverse through the housing and a maximum number of holes 72 and 73 exposed to slots 62 and 63. Linkage 76 is designed to be adjustable so that homogenizer 20 can be adjusted for each individual vehicle in which it is employed.

The shape of baffle 32 is designed for optimum turbulence of the air as it enters the housing to provide for optimum gas and air mix including the breaking of the gas particles into small particles. Also, arcuate edge 68 of the slots 62 and 63 facilitate smooth introduction of each hole 72 and 73 and the row of holes into and out of alignment of slots 62 and 63 as outer tube 28 rotates about inner tube 26. Also, the relative position between the rows of holes 72 and 73 and the slots 62 and 63 and sizes of each is such that all or none of the holes 72 and 73 can be exposed to the respective slot depending upon the relative rotational position between outer tube 28 and inner tube 26.

In summary, the main features of the homogenizer 20 of the present invention either as a replacement for an existing carburetor or as a supplemental unit to be used with a carburetor for an internal combustion engine include the following features. There is direct feed of gasoline from existing fuel pump pressure. This eliminates an accelerator pump and complicated related parts. Gasoline enters through opening 70 in inner tube 26 which is attached to the line from the fuel pump. Tube 26 has slots 62 and 63 cut at an angle allowing the gasoline to flow into a second concentric tube 28 which has two rows of holes 72 and 73 in it. The second tube 28 which fits tightly over the first tube 26 turns around the first tube revealing each hole 72 and 73 in sequence for the gas flow.

Second tube 28 is press fit into a ball 24 which turns with it. The ball has a slot or recess 32 cut in its surface to allow the air-gas mixture to flow into the manifold of engine 50. The concentric tubes are positioned so that the slots and aligned holes are in communication with recess 58 in the ball 24.

Air enters through the top opening 34 of the flow homogenizer 20 through aperture 52 in a flat plate 30 welded or otherwise conventionally affixed to or integrally formed with the top edge 40 of a tubular hollow housing 22. It has been found effective to use a flat plate ¼th of an inch thick for plate 30.

A baffle 32 extends inwardly overlying a portion of aperture 52 on the plate to create turbulence when the gasoline comes out of the exposed holes 72 and 73 in tube 28 to mix with the air entering through open upper end 34. The turbulence thus created forms a complete homogenized air/gas mixture. The gasoline is reduced to a minute particle of uniform size and is distributed evenly in the flow of air.

Rotation of the ball in tube 28 in one direction increases the air and gas introduced to the homogenizer and rotation in the opposite direction reduces the air and gas introduced to the homogenizer due to the coordinated rotation of the ball and tube 28 and accordingly the position of the holes 72 and 73 and recess 58.

The housing is a cylindrical tube which is fustro-conical in configuration and tapers inwardly from top to bottom. The top flares out for mounting of the air filter 56 of the engine thereon and the bottom has a plate 48 affixed thereto which acts as a flange and forms a base plate. This base plate 48 can be provided with hole knockouts to adapt it for use with a variety of different manifold situations on different types of internal combustion engines.

Finally, linkage 76 is L-shaped in configuration and is provided with an arrangement of different holes to facilitate its adaptability in mounting the homogenizer 20 to a variety of different types of foot peddle linkages used on different types of vehicles.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A flow homogenizer for an internal combustion engine comprising:

a hollow housing open at both ends;

a first tube extending through the walls of the housing and adapted to be connected to a fuel source;

a second tube concentrically mounted on the first tube in tight fitting relationship but being able to rotate about the first tube;

the first tube having at least one slot therein in the portion thereof in the housing and the second tube having a plurality of holes therein in a predetermined arrangement and positioned so that as the second tube rotates relative to the first tube the number of holes exposed to each slot can be changed thereby controlling the size of opening for fuel to flow through the tubes into the housing;

a damping member mounted on the second tube in the housing to rotate therewith and the damping member having a recess in a surface portion thereof to expose the opening in the second tube and to open the passageway through the housing from end to end;

the damping member being rotatable between a closed position blocking the opening between the ends of the housing and opened positions exposing the recess and the damping member to both ends of the housing;

the opened positions coordinated with the number of holes to the slot as the damping member is rotated thereby facilitating close control of the fuel and air mixture passing through the housing;

the homogenizer adapted to be connected to a source of vacuum for drawing the fuel and air mixture therethrough;

means on the homogenizer for attachment to control means for rotating the second tube and damping member in a desired manner to control fuel and air mixture parameters.

2. The invention in accordance with claim 1 wherein the housing is tubular in configuration, the damping member is in the form of a ball with a recess cut in the surface thereof, the outer diameter of the ball being slightly less than the inner diameter of the tubular housing to permit relative rotation therebetween, the first and second tubes being passed diametrically across the tubular housing through the side walls thereof and passing approximately through the center of the ball mounted in fixed position thereon so that as the second tube is rotated, the ball will rotate therewith, the portions of the tubes passing through the ball being exposed to the recess in the ball and the holes and each slot in the second and first tubes being in alignment with the recess so that as the holes come into alignment with each slot, the passageway created therebetween will open to the recess in the ball for passage of fuel from the tubes to the recess in the ball and into the tubular housing.

3. The invention in accordance with claim 1 wherein a baffle of predetermined configuration is mounted on the tubular housing in alignment with the recess and the open end of the housing through which the air passes for mixture with the fuel, the baffle having a predetermined configuration to facilitate turbulence of the air flow into the housing and mixture with the fuel from the tube thus providing for a desirable homogenized air fuel mixture.

4. The invention in accordance with claim 3 wherein the fuel is gasoline and is subjected to substantially reduced particle size of approximately uniform size and distribution evenly arranged in the flow of gas.

5. The invention in accordance with claim 2 wherein the ball is mounted adjacent the upper open end of the tubular housing, a baffle mounted on the upper end of the housing and extending over the opening in alignment with the recess in the ball, the baffle having a predetermined configuration for providing increased turbulence of the air and fuel mixture upon entrance in the recess thus forming a substantially complete homogenized air and fuel mixture whereby the fuel is reduced to minute particles of substantially uniform size and even distribution in the flow of air.

6. The invention in accordance with claim 2 wherein the inner surface tubular housing is slightly fustro-conical in configuration from top to bottom extending from a larger diameter at the upper end where the ball is located to a smaller diameter at the bottom open end which is the exit end for the fuel and air mixture.

7. The invention in accordance with claim 6 wherein the upper end of the housing is provided with a support for mounting an air filter thereon, and a laterally extending flange on the bottom end of the housing for facilitating the mounting of the homogenizer to a manifold on the internal combustion engine in a manner which facilitates introduction of the homogenized air and fuel mixture from the open bottom end of the housing into the manifold of the internal combustion engine.

8. The invention in accordance with claim 1 wherein the concentric tubes extend outwardly from both diametrically opposed points on the housing, one exposed end of the tubes having means thereon for mounting to a source of fuel and the other exposed end of the tubes having means thereon for mounting to control means for rotating the second tube and attached damping member in a desired manner.

9. The invention in accordance with claim 8 wherein the means for mounting the tubes to the control means includes a foot peddle linkage including adjustment means for removably mounting of the unit to a variety of different foot peddle arrangements on a variety of different vehicles in which the internal combustion engine is mounted.

10. The invention in accordance with claim 1 wherein there are eight aligned holes in a single row in the second tube and the slot in the first tube is formed by a pair of perpendicular edges meeting at approximately a right angle and having their free ends connected by an arcuate edge.

11. The invention in accordance with claim 2 wherein the recess in the ball is a V-shaped groove and the ball is enclosed within the side walls of the housing adjacent to the upper open end thereof.

12. The invention in accordance with claim 1 wherein there are two slots in the first tube and the slots are spaced apart approximately one third of the distance around the circumference of the first tube, and an arrangement of holes in the second tube provided in position for exposure to each slot.

* * * * *